US005556005A

United States Patent [19]

Banks

[11] Patent Number: 5,556,005

[45] Date of Patent: Sep. 17, 1996

[54] COLLAPSIBLE SOAP DISPENSER

[75] Inventor: Stewart Banks, Brantford, Canada

[73] Assignee: Sprintvest Corporation NV, Netherlands Antilles

[21] Appl. No.: 370,035

[22] Filed: Jan. 9, 1995

[51] Int. Cl.[6] ..... B65D 35/54

[52] U.S. Cl. ..... 222/96; 222/105; 222/181.1; 222/325; 222/340; 222/523; 251/149.1

[58] Field of Search ..... 222/95, 96, 105, 222/153.01, 181.1, 181.2, 181.3, 185.1, 321.8, 325, 340, 383.1, 523; 251/149.1, 149.2

[56] References Cited

U.S. PATENT DOCUMENTS

| | | | |
|---|---|---|---|
| Re. 32,354 | 2/1987 | Savage | 222/105 X |
| 3,223,435 | 1/1966 | Kanamaru | 141/286 |
| 3,559,846 | 2/1971 | Goodrich | 222/107 |
| 3,727,803 | 4/1973 | Cobb | 222/95 X |
| 3,915,314 | 10/1975 | Brown | 222/325 X |
| 3,926,341 | 12/1975 | Lhoest | 222/95 |
| 4,151,867 | 5/1979 | Wilhere | 141/291 |
| 4,360,130 | 11/1982 | Nishimura et al. | 222/181.2 X |
| 4,437,585 | 3/1984 | Banks | 222/181.2 |
| 4,667,710 | 5/1987 | Wu | 141/198 |
| 4,874,023 | 10/1989 | Ulm | 141/346 |
| 4,949,877 | 8/1990 | Hanna et al. | 222/383.1 X |
| 4,991,635 | 2/1991 | Ulm | 141/346 |
| 5,031,676 | 7/1991 | Ulm | 141/346 |
| 5,108,007 | 4/1992 | Smith et al. | 222/95 |
| 5,121,778 | 6/1992 | Baker et al. | 222/185.1 X |
| 5,178,300 | 1/1993 | Haviv et al. | 222/95 |
| 5,207,250 | 5/1993 | Tsao | 141/65 |
| 5,232,125 | 8/1993 | Adams | 222/83.5 |
| 5,273,083 | 12/1993 | Burrows | 141/18 |
| 5,320,256 | 6/1994 | Wood | 222/212 |

*Primary Examiner*—Joseph Kaufman
*Attorney, Agent, or Firm*—Lynn C. Schumacher; Hill & Schumacher

[57] ABSTRACT

A dispenser comprises a collapsible bottle and a valve assembly for placement in the throat of the bottle which includes a first hollow valve member sealed in the throat of the bottle and a hollow second valve member having apertures in the side wall. The second valve member telescopes in the first valve member between a closed position in which the apertures are located within the channel of the first valve member to close the bottle and an open position in which the apertures are in flow communication with the interior of the bottle. The first and second valve members are dimensioned to receive a probe forming part of a dispenser pump mechanism. The bottle is provided with crease lines located on the front, back and sides so that the bottle collapses as liquid is pumped out of the bottle to prevent exposure of the liquid contents to air.

25 Claims, 5 Drawing Sheets

COLLAPSIBLE SOAP DISPENSER

BACKGROUND OF THE INVENTION

1. Field of the Invention

The present invention relates to soap dispensers for holding and dispensing fluids such as liquid cleaning agents and the like. More specifically the invention is directed to collapsible containers and valves attached thereto which do not admit air as liquid is being dispensed so that, as liquid is pumped out, the container collapses.

2. Background of the Related Art

This invention relates to improved dispensers for dispensing liquids such as detergents and soaps from containers. Many types of liquid soaps and detergents for personal hygiene are supplied in bottles designed to be inserted into dispensers provided with hand actuated pumps. The bottles generally have a cap designed to be removed from the bottle when the latter is inserted into the dispenser or a seal designed to be punctured or torn off when the bottle is positioned in the dispenser. A drawback to this arrangement is that the bottles can leak when removed from the dispenser thereby creating a mess. A more serious problem relates to the actual method of dispensing the liquids from the bottles. Many dispensers of this type are designed so that, as liquid is pumped from the bottle, air back flows into the bottle to replace the displaced liquid. This can lead to degradation and shorted lifetime of the liquid soap due for example to oxidation. In addition, evaporation of the liquid occurs causing thickening of the soap and may result in blockages in the pumping mechanism.

Accordingly, it would be advantageous to provide a dispenser for dispensing liquid soaps and the like having an economical and reusable valve assembly which automatically opens as the bottle engages the pumping mechanism and closes as the bottle is disengaged from the dispenser and which reduces back flow of air into the bottle as liquid is being dispensed from the bottle.

SUMMARY OF THE INVENTION

The subject invention provides a bottle and valve assembly for liquids comprising a plastic bottle having a throat portion and a plastic valve assembly. The valve assembly comprises a first valve member being sealingly engagable in the throat portion and defining a channel, and a second valve member having apertures and defining a passageway coaxial with the channel in the first valve member. The second valve member is constrained to sliding movement within the first valve member between a closed position wherein the apertures are located within the channel of the first valve member whereby the throat is sealed closed, and an open position wherein the apertures are at least partially free of the first valve member and in communication with the interior of the bottle. The channel of the second valve member is dimensioned to receive a dispensing probe defining a central passageway which may be brought into flow communication with the apertures as the second valve member is forced open with respect to the first valve member.

In another aspect of the invention there is provided a dispenser for dispensing liquids such as soap. The dispenser comprises a dispenser housing and a hand actuated dispenser mechanism mountable in the dispenser housing. The hand actuated dispenser mechanism includes a probe defining a passageway in communication with a discharge outlet and means for pumping liquid from the passageway to the discharge outlet. The dispenser includes a plastic bottle having a throat portion and a plastic valve assembly receivable in the throat portion. The plastic valve assembly includes a first valve member being sealing engagable in the throat portion and defining a channel, and a second valve member having apertures and defining a channel. The second valve member is constrained to sliding movement within the channel of the first valve member between a closed position wherein the apertures are located within the channel of the first valve member whereby the throat of the bottle is sealed closed, and an open position wherein the apertures are at least partially free of the first valve member in communication with the interior of the bottle. The channels are dimensioned to receive the dispensing probe so the passageway of the probe is in flow communication with the apertures.

The first and second valve members are provided with interlocking components to retain the valve closed unless the valve is opened by the probe. Components are also provided to lock and seal the valve assembly to the probe.

BRIEF DESCRIPTION OF THE DRAWINGS

The following is a description, by way of example only, of the collapsible dispenser for dispensing liquids forming the present invention, reference being had to the accompanying drawings, in which.

DETAILED DESCRIPTION OF THE INVENTION

Figure 1:
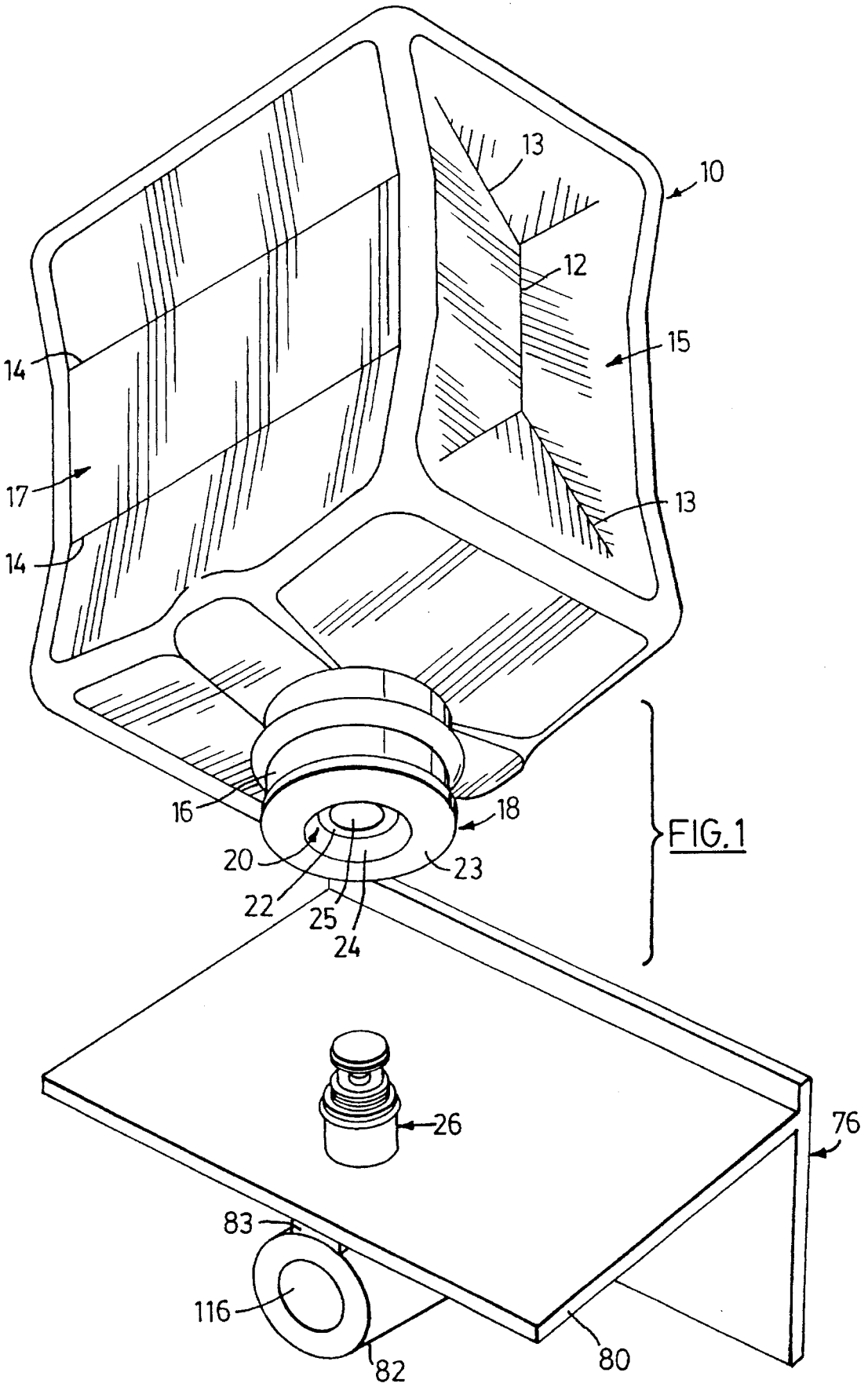
FIG. 1 is a perspective assembly view of a collapsible bottle and part of a dispenser mechanism in accordance with the present invention.

Referring first to FIG. 1, a collapsible container or bottle 10 fabricated of flexible plastic is provided with vertical crease lines 12 and angled crease lines 13 on the sides 15 thereof and horizontal crease lines 14 extending across the front 17 and back surfaces thereof. A throat 16 is provided for discharging the contents from the bottle 10 and a plastic valve assembly 18 is inserted into and bonded to throat 16.

Figure 3:
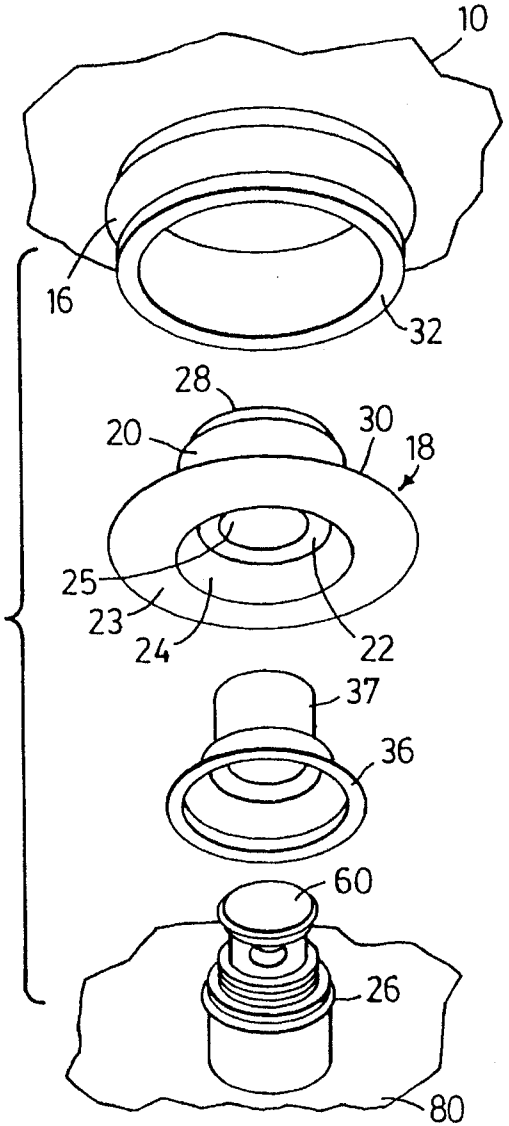
FIG. 3 is an assembly perspective view, having portions broken away, of the bottle and valve insert assembly of the present invention showing a removable closure seal.
Figure 2:
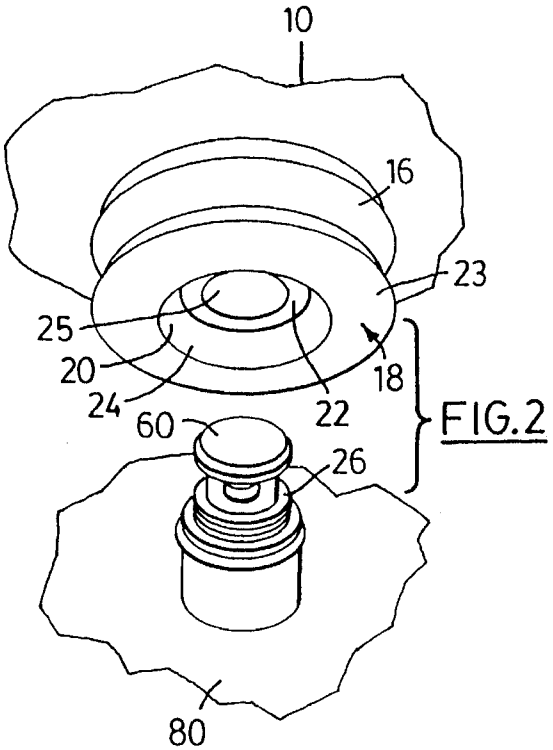
FIG. 2 is a perspective assembly view of the throat portion of the collapsible bottle and valve and part of the dispenser mechanism shown in FIG. 1 with a portion of the bottle broken away.

With reference to FIGS. 2 and 3, plastic valve assembly 18 comprises two cylindrically-shaped members 20 and 22. An outwardly extending flange 23 is integrally formed with member 20. The flange has an outer bifurcated generally annular lip 30 which engages the rim 32 of the throat of the bottle. Cylindrical member 20 has a central channel 24 extending therethrough. Member 22 has a channel 25 therein and is of a size to fit within member 20 so as to be telescopingly movable with respect thereto. In use, a probe or section of a discharge pump mechanism, shown generally at 26, is engaged in members 20 and 22 of valve assembly 18 to be described later.

Bottle 10 is filled with the desired liquid after which valve assembly 18 is closed by a closure member 36 (seen in FIG. 3) which is inserted therein. The valve assembly is ultrasonically welded along flange lip 30 to rim 32 of throat 16 to provide an air-tight seal. Closure member 36 includes a cylindrically shaped section 37 which is closed at the end. The closure member snaps into member 22 of valve 18 to act as a seal to prevent leakage from bottle 10. Bottle 10 with closure member 36 sealing valve assembly 18 may be shrink wrapped and distributed to customers.

More details of valve assembly 18 and section 26 of the dispensing mechanism and how they are engaged and disengaged are shown in FIGS. 5 to 8. Cylindrically-shaped member 22 has apertures 38 through the walls thereof which communicate with channel 25. End portion 28 has an outer concave flange 40 which abuts an in-turned annular flange 42 of cylindrical member 20 to limit the inward movement of member 22. Shown exaggerated in size in FIGS. 5 and 6, cylindrical member 22 also has an annular rib 48 spaced from end portion 28. At the other end of cylindrical member 22 is an inwardly projecting annular lip 44. The cylindrical member 22 also has an outwardly projecting shoulder 46 which extends around the exterior thereof to limit the outward movement of the member by abutting against the inner surface of in-turned flange 42. When cylindrical member 22 is telescopically extended within member 20 relative to the interior of bottle 10, a flow path from the interior of the bottle is created through the apertures 38 and channel 25. Conversely, when cylindrical member 22 is seated within member 20, bottle 10 is sealed against leakage of the bottle contents. Rib 48 and in-turned flange 42 cooperate to lock member 22 to member 20 in the closed position as the rib snaps over the flange. The flange 42 is thus seated within a recess 27 formed between the rib 48 and the flange 40 of the member 22 thereby sealing the bottle.

Section 26 of the pump mechanism comprises a hollow cylindrical member 50 which extends from a plate 80 and is provided with an annular groove in which an O-ring 52 is seated. Section 26 also includes a cylindrical member 54, of reduced diameter compared to member 50, which is provided with an outer annular groove 56 along with several apertures 58 in the wall thereof and an outer closed end 60. Members 50 and 54 of pump section 26 define a probe or tap having a liquid flow channel 62.

Figure 4:
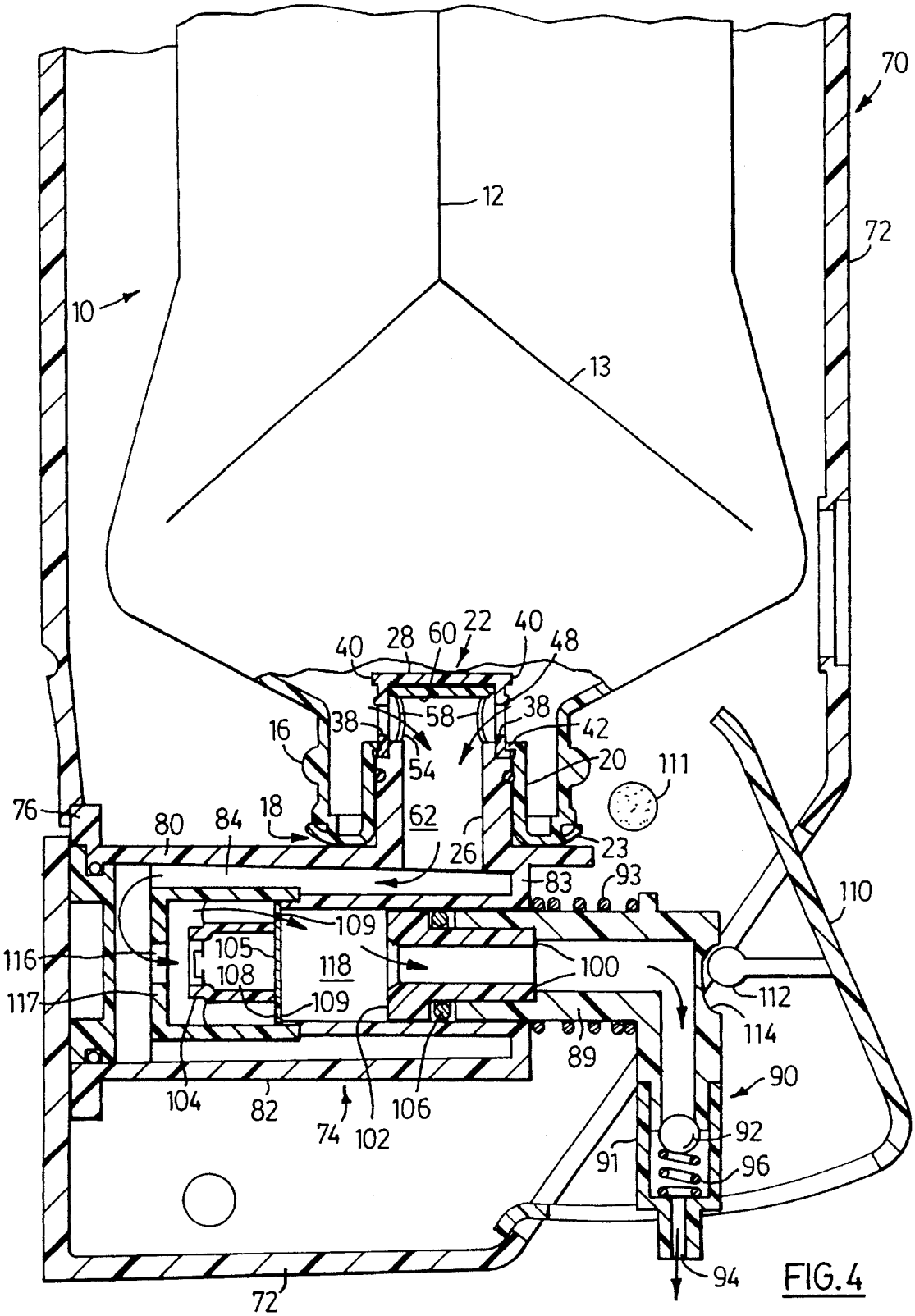
FIG. 4 is a cross-sectional view, having portions broken away, of an assembled soap dispenser in use with the collapsible bottle and valve in the open position.

Collapsible bottle 10 is used in conjunction with a dispenser shown generally at 70 in FIG. 4. Dispenser 70 includes a housing 72 containing a pump mechanism shown at 74. Pump mechanism 74 comprises a bracket 76 including plate 80 and pump section 26. A hollow cylinder 82 is integrally formed with and depends from plate 80 by a hollow connection 83. Connection 83 defines a channel 84 which communicates the cylinder with the flow channel 62 of pump section 26. Thus flow channel 62 and channel 84 form a flow path for liquid being pumped out of bottle 10 through valve 18.

Figure 6:
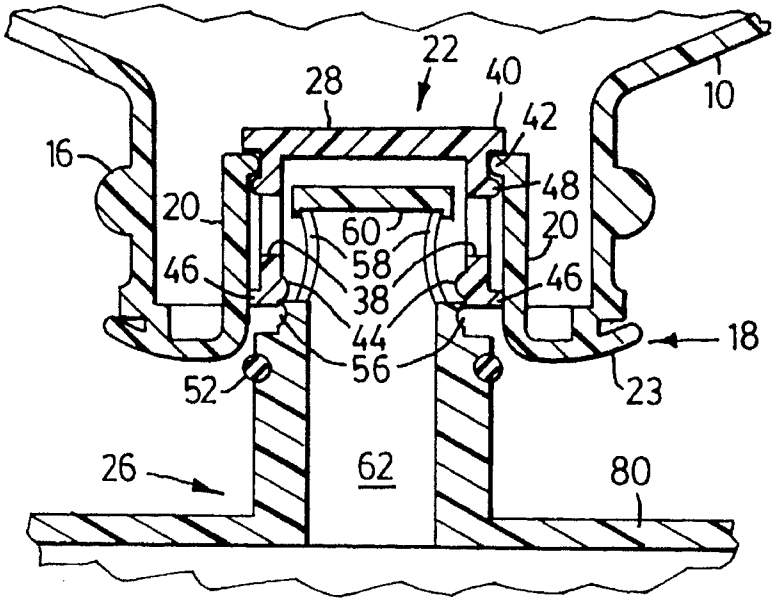
FIG. 6 is a view similar to FIG. 5 showing the valve assembly and part of the dispenser mechanism partially coupled together.
Figure 5:
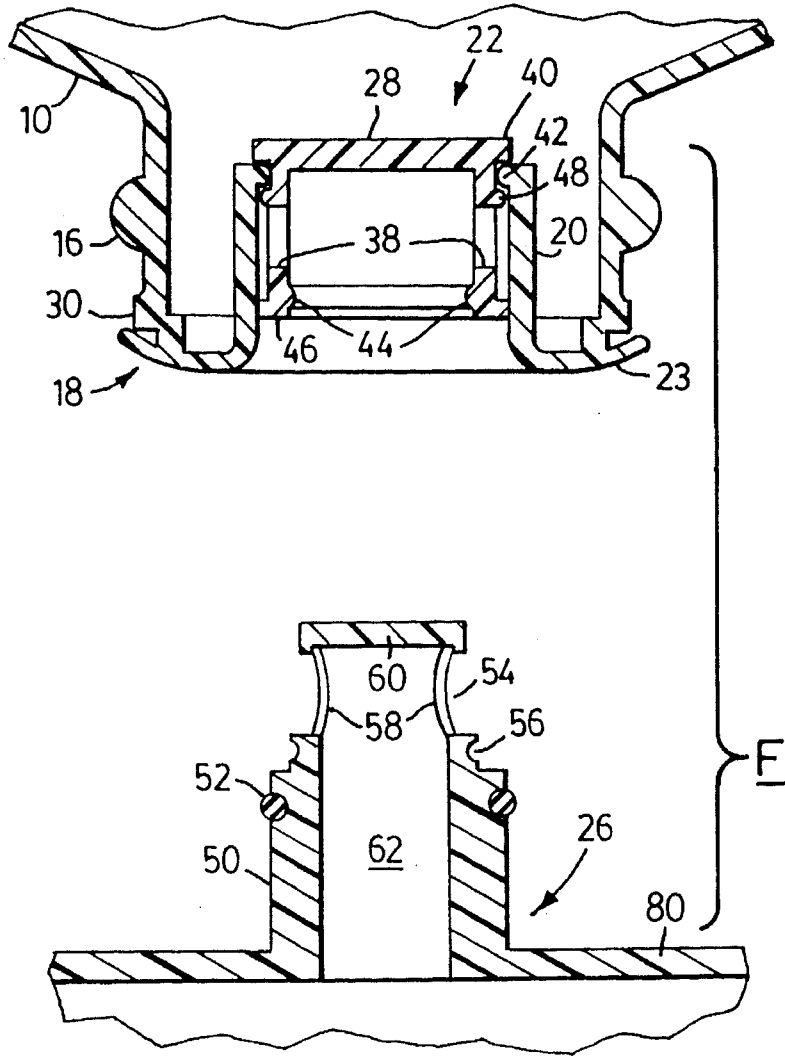
FIG. 5 is a cross-sectional view of the valve assembly and the collapsible bottle and part of the dispenser mechanism prior to being coupled together.
Figure 7:
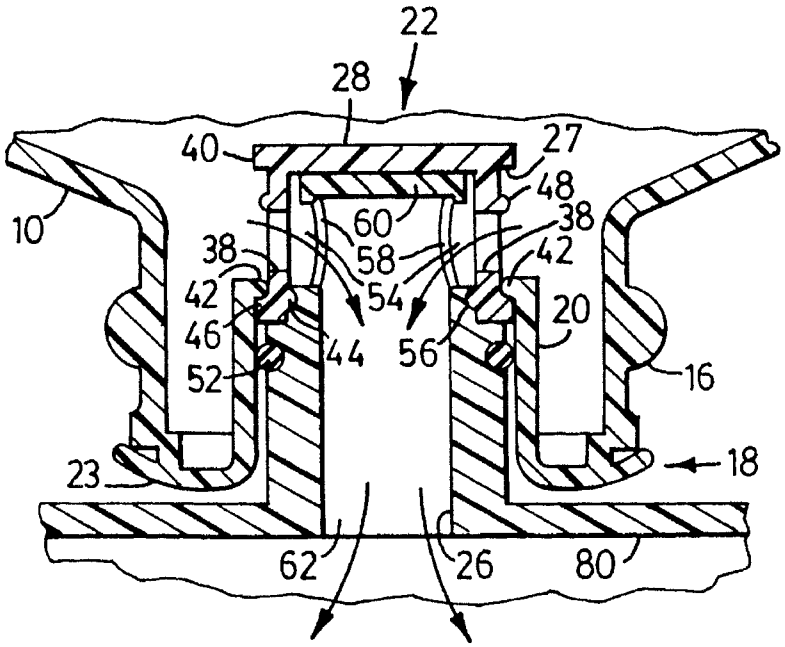
FIG. 7 is a view similar to FIG. 6 showing the valve assembly fully engaged with part of the dispenser mechanism.

Bottle 10 is assembled with dispenser 70 for use by first removing closure member 36 from valve assembly 18 and then positioning the bottle in dispenser housing 72. The relative positioning of the bottle and pump section 26 prior to engagement of the former to the latter is as shown in FIG. 5. Referring now to FIGS. 6 and 7, the bottle is pushed down onto pump section 26 so that cylindrical member 54 is received within cylindrical member 22 of valve 18. Cylindrical member 54 bears on sliding cylinder member 22 thereby moving it within member 20. Further pushing of the bottle onto pump section 26 results in member 22 being pushed into the bottle until shoulder 46 abuts against the inner surface of in-turned flange 42, as best seen in FIG. 7. In this position, lip 44 of cylindrical member 22 has snapped into the groove 56 in cylindrical member 54 of pump section 26 thereby locking member 22 with pump section 26. In this position apertures 38 and 58 are in registration so that a liquid flow path is provided from the interior of the bottle through valve 18 and channel 62, as indicated by the arrows in FIG. 7. O-ring 52 provides a seal between cylindrical member 20 and pump section 26 primarily to prevent back flowing of air into the bottle and also to prevent leakage of liquid from the bottle.

Figure 8:
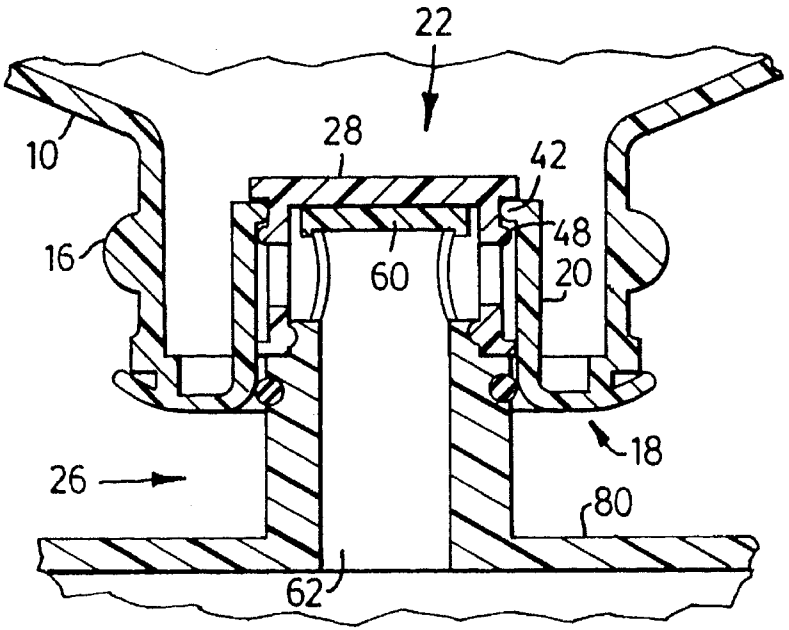
FIG. 8 is a cross-sectional view similar to FIG. 7 with the collapsible bottle in the closed position.

When the bottle is removed from dispenser 70 it is pulled upwardly so that movable member 22 is pulled back into cylindrical member 20 until its flange 40 abuts against flange 42 thereby closing the bottle, see FIG. 8. Further pulling of the bottle causes lip 44 to snap out of groove 56 so that the bottle is disengaged from the pump mechanism and may be reused later, if liquid remains, or recycled if empty.

Referring again to FIG. 4, pump mechanism 74 may be a standard pump for dispensing liquids and includes an L-shaped piston 90 having a cylindrical arm 91 extending vertically and a cylindrical horizontal arm 89. A discharge outlet 94 is located at the lower end of arm 91. A ball valve 92 is located adjacent to discharge outlet 94 and is biased in the closed position by a spring 96. A cylindrically shaped insert 102 is located in the end of arm 89 and abuts against an annular shoulder 100 in the interior of the arm. An O-ring 106 provides an air-tight seal between insert 102 and the end portion of arm 89 within cylinder 82 to prevent back flow of air into bottle 10 through the pump mechanism. A spring 93 on arm 89 acts to bias piston 90 in the open position shown in FIG. 4. A shuttle valve 104 is located on the interior of cylinder 82 and includes a circular disc 105 attached at one end thereof. Disc 105 has a plurality of holes 108 distributed about the periphery thereof. Shuttle valve 104 moves between the position shown in FIG. 4 with disc 105 abutting an annular shoulder 109 on the interior edge of cylinder 82 and a position in which the shuttle valve is moved to the left to close off an aperture 116 through a cap 117 mounted to the inner end of cylinder 82. A chamber 118 is located between arm 89 and shuttle valve 104 in the interior of cylinder 82.

Dispenser 70 includes a hand actuated lever 110 pivotally mounted to housing 72 about a pivot axis 111. A rod extends from the lever and has a spherically shaped outer end 112 which is seated in an indentation 114 in the wall of arm 91 of piston 90. When lever 110 is pushed inwardly against spring 93, arm 89 is forced to the left, as shown, into the interior of cylinder 82 which pushes shuttle valve 104 backwards to the left thereby sealing off aperture 116 and pressurizing the contents in chamber 118 and the arms of piston 90. Once the liquid contents are pressurized, ball valve 92 is forced downwardly against spring 94 to open the valve, thereby expelling the liquid charge held in chamber 118 and the arms of piston 90. Upon releasing lever 110, ball valve 92 is biased back to the closed position by spring 96 and spring 93 returns piston 90 to its original position which pulls shuttle valve 104 back to bear against shoulder 109. This creates a partial vacuum through the pump mechanism 74 thereby drawing liquid within bottle 10 in the direction of the arrows down through passageways or channels 62 and 84, through aperture 116 and holes 108 into chamber 118 and the arms of piston 90.

Valve assembly 18 is very advantageous because it provides an air-tight seal and may be opened and closed multiple times so bottle 10 can be re-sealed and replaced without leakage.

As liquid such as soap or detergent is dispensed from bottle 10 by vacuum or suction, the air tight seal at valve assembly 18 prevents air being drawn into bottle 10 so that it slowly collapses along crease lines 12, 13, and 14 (FIGS. 1 and 4) as the liquid volume decreases. Reducing exposure of the liquid to air by collapsing the bottle decreases oxidation of the soaps and detergents which advantageously increases the lifetime of the liquid. In addition, evaporation of water from the liquid is significantly decreased which helps to prevent thickening of the liquid soaps and detergents so that clogging of the dispensing mechanism is reduced.

It will be appreciated by those skilled in the art that the combination of the collapsible bottle 10 with the valve assembly 18 may be used with numerous types of dispensers. Therefore, while the dispenser for dispensing liquids utilizing the re-sealable valve assembly and collapsible bottle has been described and illustrated with respect to the preferred embodiment, it will be appreciated that numerous variations may be readily made without departing from the scope of the invention disclosed herein.

I claim:

1. A bottle and valve assembly for dispensing liquids when a dispensing probe is inserted within the valve assembly, comprising:

a) a bottle having a throat portion and an interior; and b) a valve assembly including a first valve member being sealingly engagable in said throat portion and defining a channel extending therethrough, a second valve member having a channel and at least one aperture communicating with said channel therein, said second valve member being constrained to slide within said channel of said first valve member between a closed position wherein said at least one aperture is located within said channel of said first valve member and said throat portion is sealed closed, and an open position wherein a portion of said second valve member is located within said channel of said first valve member and said at least one aperture is at least partially free of said first valve member and in communication with said interior of said bottle, said channel of said second valve member being dimensioned to receive the dispensing probe and said valve assembly including means to seal said valve assembly to the probe when the probe is received within said channel of said second valve member.

2. The bottle and valve assembly according to claim 1 wherein said bottle is a collapsible plastic bottle.

3. The bottle and valve assembly according to claim 2 wherein said collapsible plastic bottle is substantially rectangular shaped and comprises a front and back and opposed sides, and substantially vertical crease lines on each of said opposed sides and substantially horizontal crease lines on said front and back.

4. The bottle and valve assembly according to claim 1 wherein said first valve member and said second valve member include means for locking said second valve member with respect to said first valve member in the closed position.

5. The bottle and valve assembly according to claim 1 including a closure member adapted to fit into said channel of said second valve member to thereby seal said throat portion of said bottle.

6. The bottle and valve assembly of claim 1 in which said first valve member includes an outwardly extending flange, said throat of said bottle having a rim, and said outwardly extending flange being sealed to said rim.

7. The bottle and valve assembly of claim 6 in which said first valve member includes an in-turned flange extending partially into said channel therethrough, and said second valve member includes a recess into which said in-turned flange is seated when said second valve member is in said closed position.

8. The bottle and valve assembly of claim 7 in which said second valve member includes a closed end having a flange portion, said flange portion being engageable with said in-turned flange of said first valve member when in said closed position.

9. The bottle and valve assembly of claim 8 in which said second valve member includes an outwardly extending rib spaced from said flange portion thereof, said in-turned flange being snap-fitted over said rib and into said recess when said second valve member is in said closed position.

10. The bottle and valve assembly of claim 9 in which said second valve member includes an outwardly projecting shoulder spaced from said closed end and said shoulder being engageable with said in-turned flange of said first valve member when said second valve member is in said open position.

11. The bottle and valve assembly of claim 10 in which said means to seal said valve assembly to the probe includes an inwardly directed lip extending into said channel of said second valve member.

12. A dispenser for dispensing liquid soap, comprising:

a) a dispenser housing and a hand actuated dispenser mechanism mountable in said dispenser housing, said hand actuated dispenser mechanism including a probe defining a fluid flow channel in communication with a discharge outlet and means for pumping liquid from said fluid flow channel to said discharge outlet; and b) a bottle having an interior and a throat portion, a valve assembly mounted within said throat portion, said valve assembly including a first valve member being sealingly engageable in said throat portion and having a channel therethrough, a second valve member having at least one aperture in a side wall thereof and having a channel, said second valve member being slidably movable within said channel of said first valve member, said second valve member including means for constraining the sliding movement within said channel of said first valve member between a closed position wherein said at least one aperture is located within said channel of said first valve member and said throat is sealed closed, and an open position wherein a portion of said valve second member is located within said channel of said first valve member and said at least one aperture is at least partially free of said first valve member and in communication with said interior of said bottle, said channels of said first and second valve members being dimensioned to receive said probe so that said fluid flow channel of said probe is in flow communication with said at least one aperture, and means for sealing said probe in said channels of said first and second valve members.

13. The dispenser according to claim 12 wherein said bottle is a collapsible plastic bottle which collapses as liquid is pumped therefrom.

14. The dispenser according to claim 13 wherein said collapsible bottle is substantially rectangular shaped and comprises front and back surfaces and opposed sides, substantially horizontal crease lines in said front and back surfaces, and substantially vertical crease lines in said opposed sides.

15. The dispenser according to claim 12 wherein said hand actuated dispenser mechanism includes a cylinder and piston means receivable in said cylinder, said cylinder being in flow communication with said fluid flow channel of said probe, said piston means including said discharge outlet, and a lever operably coupled to said piston means for pumping liquid from said bottle through said probe and cylinder to said discharge outlet.

16. The dispenser according to claim 12 wherein said first valve member and second valve member include engaging means for locking said second valve member with respect to said first valve member in the closed position.

17. The dispenser according to claim 12 including a closure member adapted to fit into said channel of the second valve member to thereby seal said throat of said bottle.

18. The dispenser according to claim 12 wherein said second valve member and said probe include cooperating lock means for locking said second valve member with respect to said probe when said second valve member is in the closed position.

19. The dispenser according to claim 18 in which said probe has a first cylindrical portion of a first diameter and a second cylindrical portion of a second lesser diameter, said fluid flow channel of said probe extending through said first cylindrical portion and into said second cylindrical portion, said second cylindrical portion having a closed end, and at least one aperture in said second cylindrical portion.

20. The dispenser according to claim 19 in which said cooperating locking means includes a groove in said second cylindrical portion of said probe, and said second valve member includes an inwardly extending lip engageable within said groove.

21. The dispenser of claim 20 in which said first valve member includes an in-turned flange extending partially into said channel therethrough, and said second valve member includes a recess into which said in-turned flange is seated when said second valve member is in said closed position.

22. The dispenser of claim 21 in which said second valve member includes a closed end having a flange portion, said flange portion being engageable with said in-turned flange of said first valve member when in said closed position.

23. The dispenser of claim 22 in which said second valve member includes an outwardly extending rib spaced from said flange portion thereof, said in-turned flange being snap-fitted over said rib and into said recess when said second valve member is in said closed position.

24. The dispenser of claim 23 in which said second valve member includes an outwardly projecting shoulder spaced from said closed end, and said shoulder being engageable with said in-turned flange of said first valve member when said second valve member is in said open position.

25. A bottle and valve assembly for dispensing liquids when a dispensing probe is inserted within the valve assembly, comprising:

a) a bottle including a throat portion and an interior; and b) a valve assembly including a first valve member being sealingly engagable in said throat portion and defining a first channel extending therethrough, a second valve member defining a second channel and at least one aperture communicating with said said second channel, said second valve member being constrained to slide within said first channel between a closed position in which said at least one aperture is located within said first channel and said throat portion is sealed closed, and an open position in which said at least one aperture is at least partially free of said first valve member and in communication with said interior of said bottle, said first valve member includes an in-turned flange extending partially into said first channel, said second valve member includes a closed end and an outwardly projecting shoulder spaced from said closed end, said shoulder being engageable with said in-turned flange when said second valve member is in said open position, and said second channel being dimensioned to receive the dispensing probe and said valve assembly including means to seal said valve assembly to the probe when the probe is received within said second channel.

* * * * *